US008636487B2

(12) United States Patent
Mitchell

(10) Patent No.: US 8,636,487 B2
(45) Date of Patent: Jan. 28, 2014

(54) DUAL STAGE PUMP HAVING INTERMITTENT MID-SHIFT LOAD SUPPORTS

(75) Inventor: Scott Laurence Mitchell, Shropshire (GB)

(73) Assignee: Perkins Engines Company Limited, Peterborough (GB)

( * ) Notice: Subject to any disclaimer, the term of this patent is extended or adjusted under 35 U.S.C. 154(b) by 972 days.

(21) Appl. No.: 12/597,390

(22) PCT Filed: Apr. 26, 2007

(86) PCT No.: PCT/IB2007/002988
§ 371 (c)(1),
(2), (4) Date: Apr. 1, 2010

(87) PCT Pub. No.: WO2008/132542
PCT Pub. Date: Nov. 6, 2008

(65) Prior Publication Data

US 2010/0189582 A1 Jul. 29, 2010

(51) Int. Cl.
*F03C 2/00* (2006.01)
*F04C 11/00* (2006.01)
*F04C 23/00* (2006.01)

(52) U.S. Cl.
USPC ..... 418/206.7; 418/1; 418/9; 418/191; 418/200; 384/102; 384/126; 384/624

(58) Field of Classification Search
USPC ..... 418/1, 9, 191, 200, 206.7; 384/102, 384/126, 624
See application file for complete search history.

(56) References Cited

U.S. PATENT DOCUMENTS

| | | | | |
|---|---|---|---|---|
| 2,714,857 | A * | 8/1955 | Albright et al. | 418/202 |
| 3,096,719 | A * | 7/1963 | McAlvay | 418/132 |
| 3,291,052 | A | 12/1966 | Weaver et al. | |
| 3,694,113 | A | 9/1972 | Jones et al. | |
| 3,841,724 | A * | 10/1974 | Calabrese | 384/625 |
| 4,057,375 | A | 11/1977 | Nachtrieb | |
| 4,586,885 | A | 5/1986 | Middlekauff | |
| 5,197,869 | A | 3/1993 | Hansen et al. | |
| 5,290,153 | A | 3/1994 | Schmidt | |
| 5,378,130 | A * | 1/1995 | Ozeki et al. | 418/102 |
| 5,391,068 | A | 2/1995 | Uppal | |
| 5,543,236 | A | 8/1996 | Tanaka et al. | |
| 5,545,014 | A | 8/1996 | Sundberg et al. | |
| 6,241,392 | B1 | 6/2001 | Desai et al. | |
| 2005/0232784 | A1 | 10/2005 | Yates et al. | |

FOREIGN PATENT DOCUMENTS

| | | |
|---|---|---|
| DE | 32 37 974 A1 | 5/1983 |
| GB | 538128 | 7/1941 |

* cited by examiner

*Primary Examiner* — Kenneth Bomberg
*Assistant Examiner* — Anthony Ayala Delgado

(57) ABSTRACT

A hydraulic pump is disclosed. The hydraulic pump may have a first fluid section (12), a second fluid section (14), and an input shaft (16) extending through the first fluid section and the second fluid section. The input shaft may have a first end (44), a second end (46), and a mid-portion (48) located between the first and second ends. The hydraulic pump may also have a first bearing (30) configured to continuously support the first end of the input shaft, and a second bearing (32) configured to continuously support the second end of the input shaft. The hydraulic pump may further have a third bearing (56) configured to intermittently support the mid-portion (58) of the input shaft.

17 Claims, 1 Drawing Sheet

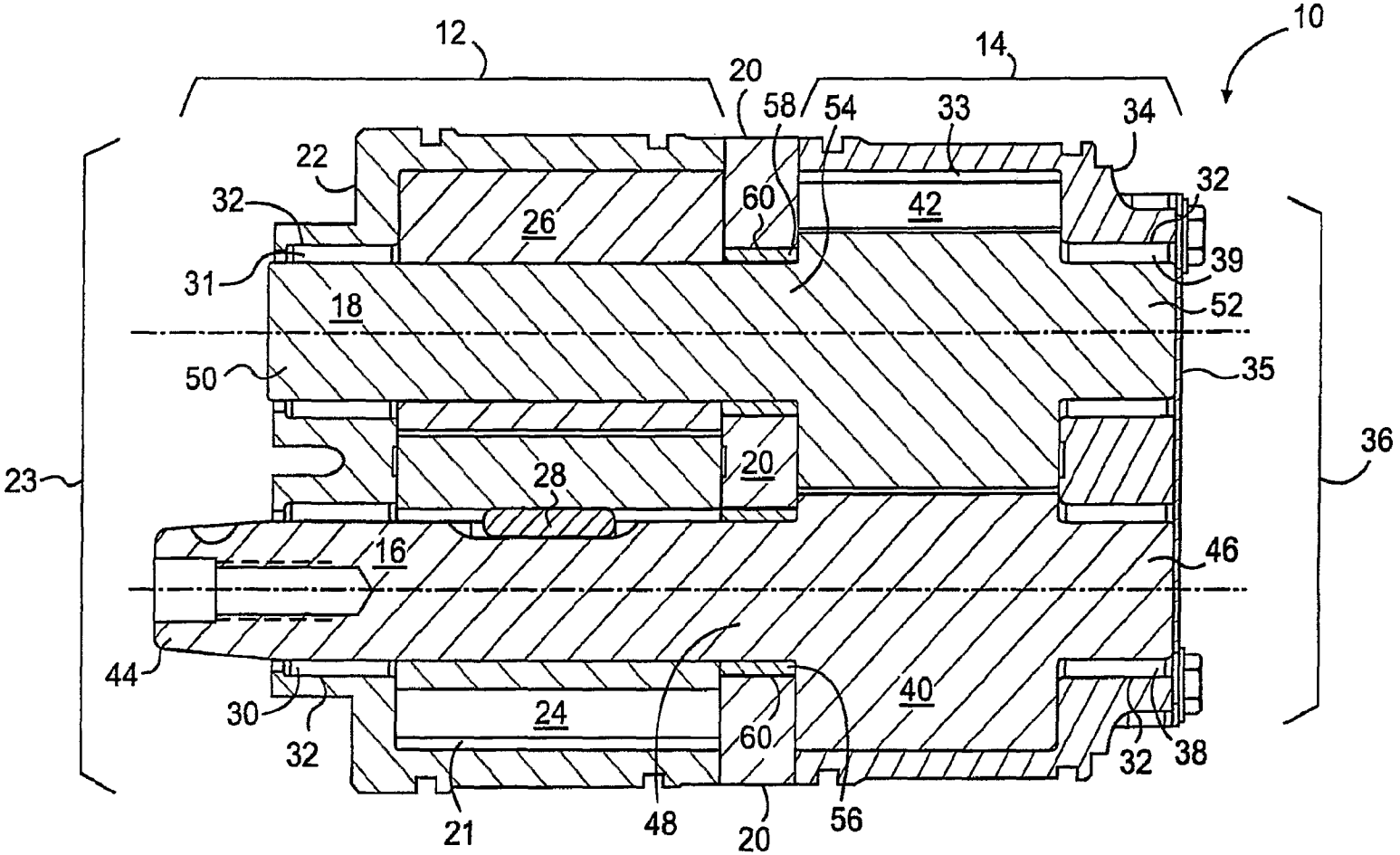
10
36
35
32
39
52
46
38
32
34
14
33
42
40
54
56
58
60
20
20
60
48
26
28
24
12
21
16
18
22
32
32
30
31
50
44
23

DUAL STAGE PUMP HAVING INTERMITTENT MID-SHIFT LOAD SUPPORTS

TECHNICAL FIELD

The present disclosure relates generally to a pump, and more particularly, to a dual stage pump having mid-shaft load supports.

BACKGROUND

Gear pumps utilize a pair of intermeshing spur gears to pump fluid by displacement at the interface of the mating gears. As the gears rotate, the gear teeth of opposing gears on an inlet side of the pump disengage creating an empty volume between the gear teeth that fills with fluid. This volume of fluid is then transported around the gears to an output side of the pump, where the gear teeth re-engage and force the fluid at an elevated pressure from the previously created volume through a discharge port. In a dual stage gear pump, the fluid exiting the discharge port of the first stage is directed to a sump or reservoir. The fluid is then directed from the sump to a second pair of intermeshing spur gears where the pressure of the fluid is increased to a desired pressure.

The displacement of a gear pump is fixed and dependent on the volume contained between adjacent gear teeth, the clearances between the teeth of intermeshed gears, and the number of stages present in the pump. To increase pump output, a width of the gear teeth may be increased, the clearances may be decreased, and/or multiple stages may be implemented. Although each of these methods may function to increase pump output satisfactorily, a mechanical limit on pump output may eventually be reached. That is, as the gear teeth increase in width, the clearances decrease, and/or additional gears are mounted to the same drive shaft (multi-stage pump), a length of the drive shaft and/or a deflection force on the drive shaft also increases. Although increasing a diameter of the drive shaft can decrease a magnitude of the force-induced deflection, size constraints may make such an increase in shaft diameter infeasible. And, because the drive shaft of typical gear pumps is supported only at the ends thereof, the deflection can reach a magnitude that causes significant wear on the gears and bearings.

One pump design that may minimize damage-causing deflection is described in U.S. Pat. No. 3,291,052 (the '052 patent) issued to Weaver et al. on Dec. 13, 1966. The '052 patent describes a tandem gear pump having a first pump and a second pump, both driven by a single input shaft and separated by a center block. Each of the first and second pumps includes a driving gear mounted to the input shaft and being paired with a driven gear. The input shaft passes through the center block and is supported on each end and at two mid-locations (at the center block) by way of lead-bronze bushings. In addition, the driven gears are also supported at each end by way of lead-bronze bushings. The lead-bronze bushings are cast in place within the center block and continuously support the input shaft and driven gears. By locating the lead-bronze bushings at a mid-location of the input shaft and driven gears, deflections at this location may be minimized.

Although the tandem pump described in the '052 patent may suffer less deflection under heavy loads because it is supported at a mid-location, it may be problematic. For example, because the input shaft is fully constrained at four different locations, the possibility of binding the shaft within the bushings may be great. In addition, lead-bronze bushings have a limited life and significant frictional losses, and when utilized to support the input shaft at each of the four locations, the tandem pump may be unreliable and inefficient.

The disclosed pump is directed to overcoming one or more of the problems set forth above.

SUMMARY OF THE DISCLOSURE

In one aspect, the present disclosure is directed to a hydraulic pump. The hydraulic pump may include a first fluid section, a second fluid section, and an input shaft extending through the first fluid section and the second fluid section. The input shaft may have a first end, a second end, and a mid-portion located between the first and second ends. The hydraulic pump may also include a first bearing located to continuously support the first end of the input shaft, and a second bearing located to continuously support the second end of the input shaft. The hydraulic pump may further include a third bearing located to intermittently support the mid-portion of the input shaft.

In another aspect, the present disclosure is directed to another hydraulic pump. This hydraulic pump may include a first fluid section, a second fluid section, and a shaft connected to drive the first fluid section and the second fluid section. The hydraulic pump may also include a needle bearing located to support the shaft, and a lead-bronze bearing located to support the shaft.

In yet another aspect, the present disclosure is directed to a method of pressurizing fluid. The method may include directing fluid into a first chamber, and rotating a shaft to force fluid from the first chamber to a second chamber. The shaft may be translationally constrained at opposing ends. The method may further include allowing the shaft to deflect an amount unrestricted at a location between the first and second chambers, and mechanically limiting a maximum deflection of the shaft at the location.

BRIEF DESCRIPTION OF THE DRAWINGS

FIG. 1 is a diagrammatic illustration of an exemplary disclosed pump.

DETAILED DESCRIPTION

FIG. 1 illustrates an exemplary embodiment of a pump 10. Pump 10 may be used to pressurize and/or transmit fluid to an internal combustion engine, a hydraulic actuator, or any other device in need of pressurized fluid. The fluid may include a lubrication fluid, a hydraulic fluid, a cooling fluid, a fuel, or any other fluid known in the art. Pump 10 may include a first pumping section 12, a second pumping section 14, and a center manifold 20 disposed to fluidly separate first pumping section 12 from second pumping section 14. Pump 10 may also include an input shaft 16 and a carrier shaft 18 common to both first pumping section 12 and second pumping section 14. It is considered that pump 10 may be a rotary type pump, such as a gear pump, a gerotor pump, a vane pump, or a lobe pump.

First pumping section 12 may have components that work to gather, pressurize, and/or transmit work fluid. First pumping section 12 may include a first pump body 22 and a first pumping assembly 23 disposed within first pump body 22.

First pump body 22 and center manifold 20 together may create a first chamber 21 to retain the work fluid and facilitate fluid pressurization and transmission by first pumping assembly 23. First pump body 22 may include one or more fluid inlets (not shown), as well as one or more fluid outlets (not shown). It is also considered that the fluid outlets may be located in center manifold 20, if desired. The fluid inlets may allow relatively low pressure fluid to enter first pumping section 12, and the fluid outlets may allow relatively high pressure fluid to exit first pumping section 12. The fluid inlets of first pump body 22 may fluidly communicate with a sump (not shown) that contains a supply of work fluid. The sump may be an oil pan, a tank, or other commonly known container used to hold fluid.

First pump body 22 may also include one or more bearing bays 32 to house bearings that support input shaft 16 and carrier shaft 18. Each bearing bay 32 may be machined, drilled, cast or otherwise formed into first pump body 22. First pump body 22 may also have openings at bearing bays 32 that allow input shaft 16 and/or carrier shaft 18 to connect to assemblies outside of first chamber 21. First pump body 22 may be fabricated from materials commonly used in pump body construction, including, but not limited to, steel, cast iron, and aluminum.

First pumping assembly 23 may be located within first chamber 21 to pressurize and transmit the work fluid. First pumping assembly 23 may include a first input gear 24 and a first driven gear 26. Both first input gear 24 and first driven gear 26 may be external spur-type gears that are aligned such that their teeth mesh upon rotation of input shaft 16. It is also considered that first input gear 24 and first driven gear 26 may alternatively be lobe type gears or an internal and external gear, respectively.

Rotation of input shaft 16 may rotate first input gear 24, which may subsequently, via its intermeshing teeth, mechanically act upon and rotate first driven gear 26. As first input gear 24 and first driven gear 26 rotate, the gear teeth on the inlet side of first pumping assembly 23 may disengage creating an empty volume between the gear teeth that fills with fluid from the fluid inlet of first pump body 22. This volume of fluid may then be transported around the gears to an output side of first pumping assembly 23. At the output side of first pumping assembly 23, the gear teeth may re-engage and force the fluid at an elevated pressure from the previously created volume through the fluid outlet of first pump body 22, thus creating a first stream of pressurized fluid.

Second pumping section 14 may have components that work to pressurize the fluid discharged from first pumping section 12. Second pumping section 14 may include a second pump body 34, an end cap 35, and a second pumping assembly 36.

Second pump body 34, center manifold 20, and end cap 35 together may create a second chamber 33 to retain the work fluid and facilitate the pressurization of fluid by second pumping assembly 36. Second pump body 34 may include one or more fluid inlets (not shown), as well as one or more fluid outlets (not shown). It is also considered that the fluid inlets may be located in center manifold 20, and the fluid outlets may be located in end cap 35, if desired. The fluid inlet of second pump body 34 may be connected via an intermediate non-pressurized tank (not shown) or may be connected directly to the fluid outlet of first pump body 22. The fluid outlet of second pump body 34 may communicate with an internal combustion engine, a hydraulic actuator, a hydraulic circuit, or any other device in need of pressurized fluid. One end of second pump body 34 may have an end cap 35 to act as a strainer to stop large debris from entering pump 10. End cap 35 may be fastened to first pump body 22 via mechanical fastening, chemical bonding, welding, brazing, or any other method know in the art. It is also considered that end cap 35 may be omitted, if desired.

Second pump body 34 and/or end cap 35 may also include one or more bearing bays 32 for housing bearings for support of input shaft 16 and carrier shaft 18. Second pump body 34 and end cap 35 may be fabricated from materials commonly used in pump body construction, including, but not limited to, steel, cast iron, and aluminum.

Second pumping assembly 36 may pressurize and transmit the work fluid. Second pumping assembly 36 may include a second input gear 40 and a second driven gear 42. Both second input gear 40 and second driven gear 42 may be external spur-type gears that are aligned such that their teeth mesh upon rotation of input shaft 16. It is also considered that second input gear 40 and second driven gear 42 may alternatively be lobe type gears or an internal and external gear, respectively.

Rotation of input shaft 16 may rotate second input gear 40, which may subsequently, via its intermeshing teeth, mechanically act upon and rotate second driven gear 42. As second input gear 40 and second driven gear 42 rotate, second pumping assembly 36 may pressurize and transport the fluid from the input to the output of second pump body 34 similar to the manner described above for first pumping assembly 23. This pressurization and transportation of fluid by second pumping assembly 36 may create a second stream of pressurized fluid.

It is contemplated that first pumping section 12 and second pumping section 14 may alternatively be used to independently generate separate output flows of pressurized fluid rather than operate as a single system, if desired. It is also considered that the operation of pump 10 may be reversed. In other words, a pressurized stream of fluid may alternatively be introduced into first pump body 22 and/or second pump body 34 to actuate first pumping assembly 23 and second pumping assembly 36 to rotate input shaft 16 and carrier shaft 18. In this configuration, input shaft 16 may become an output shaft. Furthermore, pumping assemblies 23 and 36 and pumping sections 12 and 14 may become motoring assemblies and motoring sections, respectively.

Center manifold 20 may be used to collect and distribute fluid and/or as a dividing wall between first pump body 22 and second pump body 34. First pump body 22 and second pump body 34 may attach to center manifold 20 via welding, brazing, chemical bonding, mechanical fastening (e.g., bolting, crimping), or any other method known in the art. Center manifold 20 may include one or more center bearing bays 60 associated with each of input shaft 16 and carrier shaft 18. Center bearing bays 60 may provide openings in center manifold 20 so that input shaft 16 and carrier shaft 18 may pass from first chamber 21 to second chamber 33. Center bearing bays 60 may also house bearings that support input shaft 16 and carrier shaft 18.

Input shaft 16 may be a rotatable member used to transmit torque from a power source (not shown) to first input gear 24 and second input gear 40. Input shaft 16 may have a first end 44, a second end 46, and a mid-portion 48 located between first end 44 and second end 46. First end 44 of input shaft 16 may be drivably connected to a power source, such as an electric motor, an internal combustion engine, or any other power source known in the art. First input gear 24 may be coaxially attached to input shaft 16 by way of one or more retaining keys 28. For example, one retaining key 28 may be inserted into mating cavities of first input gear 24 and input shaft 16 to constrain the axial translation of first input gear 24 along input shaft 16. Retaining key 28 may also couple the rotation of first input gear 24 to input shaft 16 such that a rotation of input shaft 16 creates a similar rotation in first input gear 24 and vice versa. Second input gear 40 may be integral with input shaft 16.

Carrier shaft 18 may also be a rotatable member having a first end 50, a second end 52, and a mid-portion 54 located between first end 50 and second end 52. First driven gear 26 may be slidably and rotatably disposed on carrier shaft 18. Second driven gear 42 may be integral with carrier shaft 18.

First pumping section 12 may include a first bearing 30 and a fourth bearing 31 to improve efficiency of the operation of first pumping assembly 23 by reducing frictional resistance to rotation of input shaft 16 and carrier shaft 18. First bearing 30 may be located to continuously support first end 44 of input shaft 16. Fourth bearing 31 may be located to continuously support first end 50 of carrier shaft 18. First bearing 30 and fourth bearing 31 may be pressed or cast into bearing bays 32 of first pump body 22. It is contemplated that multiple first bearings 30 may be used to support first end 44 of input shaft 16 and that multiple fourth bearings 31 may be used to support first end 50 of carrier shaft 18. Each of the first pumping section bearings may be a rolling-element bearing. Each rolling-element bearing may be, for example, a ball bearing, a roller bearing or a needle bearing.

Second pumping section 14 may include a second bearing 38 and a fifth bearing 39 to improve efficiency of the operation of second pumping assembly 36 by reducing frictional resistance to rotation of input shaft 16 and carrier shaft 18. Specifically, second pumping section 14 may include second bearing 38 located to continuously support second end 46 of input shaft 16, and fifth bearing 39 located to continuously support second end 52 of carrier shaft 18. Second bearing 38 and fifth bearing 39 may be pressed or cast into bearing bays 32 of second pump body 34. It is contemplated that multiple second bearings 38 may be used to support second end 46 of input shaft 16 and that multiple fifth bearings 39 may be used to support second end 52 of carrier shaft 18. Each of the second pumping section bearings may be a rolling-element bearing. Each rolling-element bearing may be, for example, a ball bearing, a roller bearing or a needle bearing.

Center manifold 20 may include a third bearing 56 and a sixth bearing 58 to provide intermittent support for input shaft 16 and carrier shaft 18. Specifically, third bearing 56 may provide intermittent support for mid-portion 48 of input shaft 16, and sixth bearing 58 may be used to provide intermittent support for mid-portion 54 of carrier shaft 18. In one embodiment, the center bearing members may be plain bearings (i.e., bearings with no rolling elements), such as lead bronze bearings.

The inner diameters of third bearing 56 and sixth bearing 58 may be larger than the outer diameters of input shaft 16 and carrier shaft 18, respectively. For example, the difference between the inner diameter of third bearing 56 and the outer diameter of mid-portion 48 of input shaft 16 may create a gap such that when input shaft 16 is in a relatively undeflected state, it is not supported by third bearing 56, and thus does not incur the associated frictional losses (i.e., does not decrease pump performance). When, however, there is sufficient deflection of input shaft 16, the input shaft's outer surface may engage the inner surface of third bearing 56 and be supported thereby. Carrier shaft 18 and sixth bearing 58 may operate in a similar manner. This deflection-dependent engagement between input shaft 16, carrier shaft 18 and the center bearing members 56 and 58, respectively may create a limit on the maximum allowable deflection of the shafts, thus minimizing excessive stress and wear on first pumping assembly 23 and second pumping assembly 36. The gap between the shafts and the bearings may be selected to optimally balance the wear and performance of pump 10.

INDUSTRIAL APPLICABILITY

The disclosed pump may be implemented in any fluid transmission system where performance and wear of the pump's components may be a consideration. Specifically, the disclosed pump may contain a rotatable shaft that is continuously supported at opposing ends and intermittently supported at the shaft's center. This central intermittent support may limit a maximum deflection of the rotatable shaft, thus reducing wear on the gears and bearings of the disclosed pump.

Pump 10 may be operated when there is low gear loading (i.e., low pump pressures). Low gear loading may occur when pump 10 is operated at a constant speed at a standard operating temperature. Low gear loading may create little or no deflection of input shaft 16 and/or carrier shaft 18. For example, under low gear loading conditions, deflection of input shaft 16 may be insufficient to engage third bearing 56. Similarly, deflection of carrier shaft 18 may be insufficient to engage sixth bearing 58. This lack of engagement of the center bearing members may minimize frictional losses and thus maximize the performance of pump 10.

Additionally, pump 10 may be operated when there is high gear loading (i.e., high pump pressures). High gear loading may occur when pump 10 is operated at idle speed with cold oil, and/or accelerated significantly. Thus, when the load on input shaft 16 exceeds a predetermined amount, input shaft 16 may deflect such that it engages third bearing 56. This engagement of third bearing 56 may limit a maximum deflection of input shaft 16. Similarly, when the load on carrier shaft 18 exceeds a predetermined amount, carrier shaft 18 may deflect such that it engages sixth bearing 58. Sixth bearing 58 may restrict the maximum deflection of carrier shaft 18. Restriction of the maximum deflection of input shaft 16 and/or carrier shaft 18 may reduce wear on the gears and bearings of pump 10.

Several advantages of the disclosed pump may be realized over the prior art. In particular, the disclosed pump may be highly efficient since it uses roller bearings. Furthermore, because the center bearing members of the disclosed pump only support the input shaft and the carrier shaft intermittently, there is little chance of binding the shafts.

It will be apparent to those skilled in the art that various modifications and variations can be made to the disclosed pump. Other embodiments will be apparent to those skilled in the art from consideration of the specification and practice of the disclosed pump. For example, the disclosed pump may be used as a compounding pump where the pressurized fluid from the first pumping section is fed directly into the second pumping section for even further pressurization. It is intended that the specification and examples be considered as exemplary only, with a true scope being indicated by the following claims and their equivalents.

What is claimed is:

1. A hydraulic pump, comprising:

a first fluid section;

a second fluid section;

an input shaft extending through the first fluid section and the second fluid section, the input shaft having a first end, a second end, and a mid-portion located between the first and second ends;

a first bearing configured to continuously support the first end of the input shaft;

a second bearing configured to continuously support the second end of the input shaft; and a third bearing configured to intermittently support the mid-portion of the input shaft.

2. The hydraulic pump of claim 1, wherein the input shaft is rotatable to cause the first and second fluid sections to produce first and second streams of pressurized fluid.

3. The hydraulic pump of claim 1, wherein pressurized fluid may be introduced to the first and second fluid sections to generate a rotation of the input shaft.

4. The hydraulic pump of claim 1, wherein the first and second bearings each include a needle bearing.

5. The hydraulic pump of claim 4, wherein the third bearing includes a plain bearing.

6. The hydraulic pump of claim 5, wherein the third bearing includes a lead bronze bearing.

7. The hydraulic pump of claim 1, wherein the third bearing only supports the input shaft when the load on the input shaft exceeds a predetermined amount.

8. The hydraulic pump of claim 1, wherein the third bearing only supports the input shaft when a deflection of the input shaft exceeds a predetermined amount.

9. The hydraulic pump of claim 1, wherein at least one of the first and second fluid sections is a gear pump.

10. The hydraulic pump of claim 1, wherein the second fluid section is connected to receive fluid from the first fluid section and increase the pressure of the fluid.

11. The hydraulic pump of claim 1, wherein each of the first and second fluid sections includes an input gear and a driven gear, the input gears of the first and second fluid sections being connected to the input shaft.

12. The hydraulic pump of claim 11, wherein the driven gears of the first and second fluid sections are connected to a carrier shaft.

13. The hydraulic pump of claim 12, wherein:

the input gear of the first fluid section is integral with the input shaft; and the driven gear of the first fluid section is integral with the carrier shaft.

14. The hydraulic pump of claim 12, further including:

a fourth bearing located to continuously support a first end of the carrier shaft;

a fifth bearing located to continuously support a second end of the carrier shaft; and a sixth bearing located to intermittently support a mid-portion of the carrier shaft.

15. A hydraulic pump, comprising:

a first fluid section;

a second fluid section;

a shaft connected to drive the first fluid section and the second fluid section;

at least one needle bearing located to support the shaft; and a lead-bronze bearing located to support the shaft, wherein the needle bearing, continuously supports the shaft and the lead-bronze bearing only intermittently supports the shaft.

16. A method of pressurizing fluid, comprising:

directing fluid into a first chamber;

rotating a shaft to force fluid from the first chamber to a second chamber, the shaft being translationally constrained at opposing ends;

allowing the shaft to deflect an amount at a location between the first and second chambers; and mechanically limiting a maximum deflection of the shaft at the location by a bearing configured to intermittently support a mid-portion of the shaft.

17. The method of claim 16, wherein rotation of the shaft also forces fluid from the second chamber.

* * * * *